US008505719B2

(12) United States Patent
Rodriguez Sanchez et al.

(10) Patent No.: US 8,505,719 B2
(45) Date of Patent: Aug. 13, 2013

(54) CROSSPIECE PACKAGING

(75) Inventors: Alonso Rodriguez Sanchez, Queretaro (MX); Francisco Javier Hurtado Regalado, Queretaro (MX); Jose Martinez Rivera, Queretaro (MX)

(73) Assignee: MABE, S.A. de C.V., Queretaro (MX)

( * ) Notice: Subject to any disclaimer, the term of this patent is extended or adjusted under 35 U.S.C. 154(b) by 0 days.

(21) Appl. No.: 13/070,742

(22) Filed: Mar. 24, 2011

(65) Prior Publication Data

US 2011/0232230 A1 Sep. 29, 2011

(30) Foreign Application Priority Data

Mar. 26, 2010 (MX) ..... MX/a/2010/003430

(51) Int. Cl.
*B65D 85/00* (2006.01)

(52) U.S. Cl.
USPC ..... 206/320; 248/346.5

(58) Field of Classification Search
USPC ..... 206/320, 446, 564, 591, 592, 594, 206/583; 248/346.03, 346.05, 568, 603, 248/613; 108/51.3; 410/117, 118; 220/629–632; 2/320, 446, 564, 591, 592, 2/594, 583
See application file for complete search history.

(56) References Cited

U.S. PATENT DOCUMENTS

| | | | | |
|---|---|---|---|---|
| 4,019,672 | A | 4/1977 | Giannini | |
| 4,093,072 | A * | 6/1978 | Black, Jr. | 206/521 |
| 4,174,622 | A * | 11/1979 | Bunnell et al. | 248/613 |
| 4,240,550 | A | 12/1980 | Collin | |
| 4,366,902 | A * | 1/1983 | Fanson et al. | 206/320 |
| 4,624,117 | A * | 11/1986 | Ory et al. | 206/320 |
| 4,700,832 | A | 10/1987 | Champ | |
| 5,016,853 | A | 5/1991 | Cox | |
| 5,117,658 | A * | 6/1992 | Bisplinghoff et al. | 248/568 |
| 5,184,727 | A * | 2/1993 | Dickie et al. | 206/591 |
| 5,257,516 | A * | 11/1993 | Hossfield | 248/613 |
| 5,503,085 | A * | 4/1996 | Rozek | 108/51.3 |
| 5,788,077 | A * | 8/1998 | Sisk | 206/493 |
| 6,357,587 | B1 * | 3/2002 | Melms, Jr. | 206/320 |
| 7,014,160 | B2 | 3/2006 | Muyskens | |
| 7,648,026 | B2 * | 1/2010 | Brittain | 206/320 |

FOREIGN PATENT DOCUMENTS

WO 2008/119634 10/2008

* cited by examiner

*Primary Examiner* — Andrew Perreault

(74) *Attorney, Agent, or Firm* — Enrique J. Mora; Beusse Wolter Sanks Mora & Maire, P.A.

(57) ABSTRACT

A base for packaging for a household appliance comprises: a tray with a first surface and a second surface substantially perpendicular to the first surface and four corners; first and second laminates, each laminate comprising a first part with an inclination; a second part with an inverse inclination to the first part; a center between the first and the second part which is substantially plane; a brace in an opposite extreme to said center; the referred to laminates are placed transversally to each other on the tray, overlapped in the center and supported on the corners of the referred to tray by means of braces; and a support over each brace of the referred to first and second laminate.

11 Claims, 9 Drawing Sheets

A

B

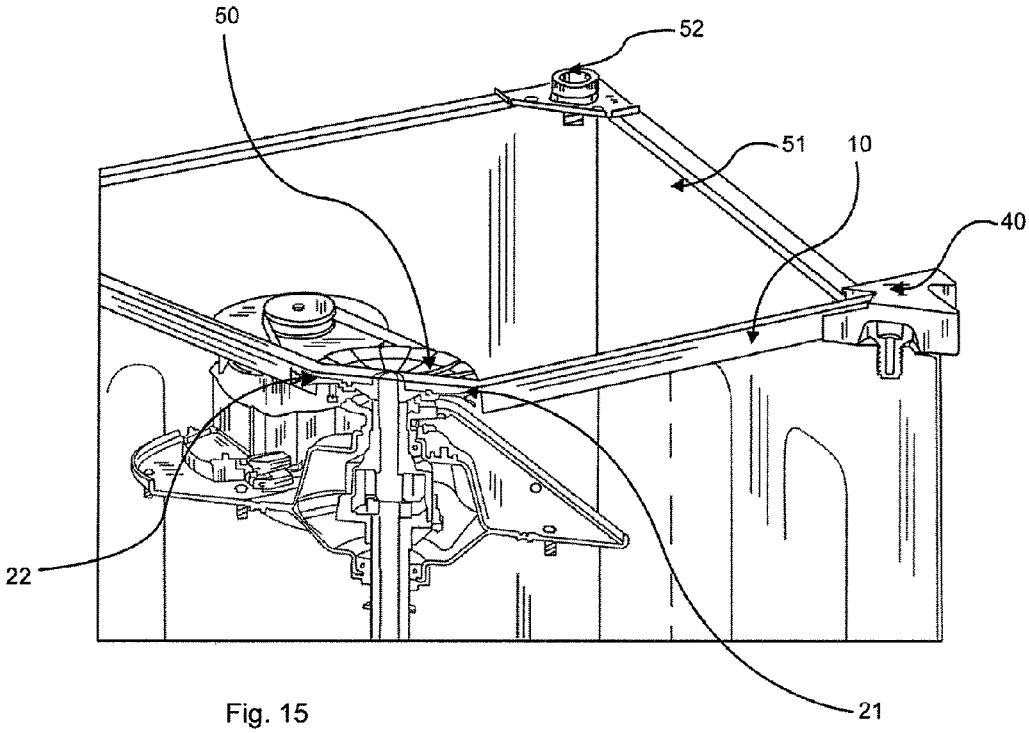
Fig. 15
Fig. 16
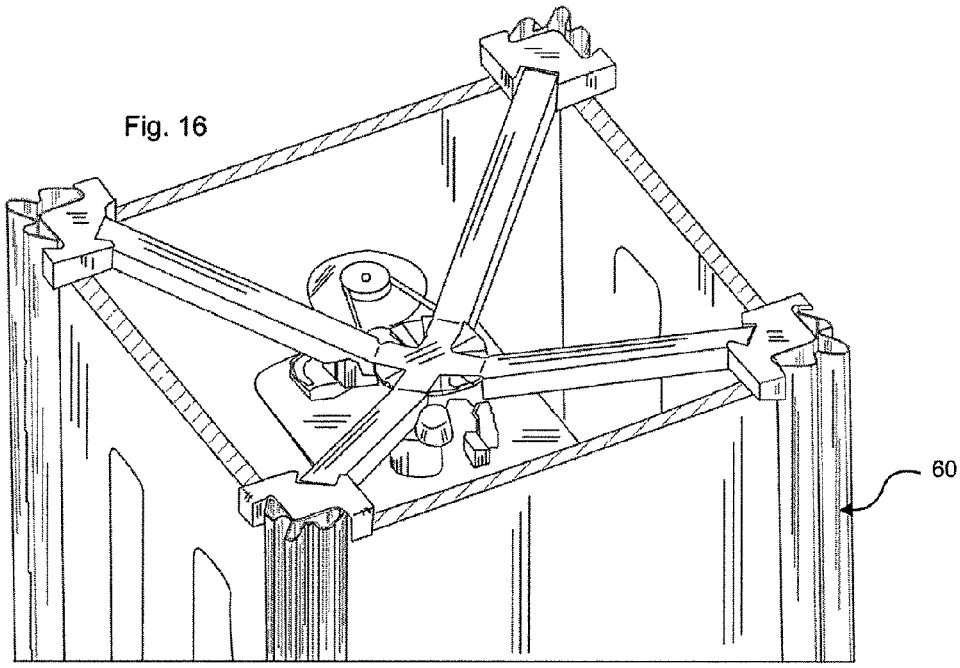

CROSSPIECE PACKAGING

RELATED APPLICATIONS

This application claims priority from Mexican application Serial No. MX/a/2010/003430 filed Mar. 26, 2010, which is incorporated herein by reference in its entirety.

FIELD OF INVENTION

The present relates to packaging for the transport of household appliances, specifically to a base for the transport of an appliance and more specifically to a base for the transport of a washing machine with a vertical axis which protects, prevents undesirable movement and cushions the impulse system and/or the transmission system of the household appliance during transport. The present invention also relates to the base, some lateral posts and a lid to protect a household appliance during transport.

BACKGROUND

In the packaging and transporting of household appliances, bases to absorb impact and vibrations are known, which exist to help in the household appliance distribution system. Certain household appliances are specifically difficult to package and transport, especially in light of the transmission systems and impulse systems having certain parts which are suspended. As an example, and not limited specifically to top loading washers, in the case of a top loading washer, there are certain internal elements which are suspended. For example, in the typical construction of a top loading washing machine, there is a tub, which is suspended unto a cabinet by means of suspension bars, shock absorbing elements such as springs and supports. A basket is placed in gyrating manner inside the tub; an agitator or propeller is found in gyrating manner within the basket. Under the tub, a transmission system is found as well as an impulse system, systems which include, among other characteristics, bands and pulleys, same which are connected to, generally, a pair of shafts by means of a clutch, where the first shaft is fastened to the agitator and the second shaft is fastened to the basket. The tub and all the parts are connected, directly or indirectly to it, and are found suspended inside the cabinet by the suspension system. This system can be applied to other household appliances. For example, a front loading dryer or washer in case they require an external support.

During the transport of household appliances, it is common that given their weight, the household appliances be tilted on their side to handle them. In the same way, it is common that the means or transport vehicle be constantly starting and breaking. They are also subjected to being handled by mechanical means. Thus, the suspended parts or the exposed parts are subject to damage from impact during transport or movement of the same, since the suspended parts can be hit against the fixed parts. For example, the tub of a washer, the transmission system and the impulse system are exposed to being hit upon impact with the washer's cabinet due to the tilting or oscillation caused during transport. The washer's cabinet, the tub, and more importantly the transmission system and the impulse system can be exposed to physical damage. This represents a cost that neither the manufacturer nor the transporter would like to incur. Thus the technical problem is how to resolve the transportation and the movement of a household appliance without causing damage to the mobile, suspended or exposed parts.

In the field, there are several attempts to resolve this issue. For example, U.S. Pat. No. 3,131,656 makes known a pallet to transport materials which is adapted for the use with a vehicle with an elevating push cart which comprises a layer of bottom support which contains a plurality of elongated parallel support members spaced, where each support member includes two vertical walls with a plurality of slots in one wall, these being oriented in a coincidental relationship to the slots of the other wall, a lower horizontal support wall joins the two vertical walls, an upper layer of support which contains a plurality of parallel support members spaced in inter-restraint relationship to the members of the lower support layer, and being in left angles within the same, at least some of the lower support members comprise a hollow elongated rectangular unit which has two vertical external sections towards the top and two internal vertical sections towards the top, and an upper section and two lower horizontal sections, a plurality of rectangular dependant tongues which extend towards under the two external vertical sections of said unit, one slot adjacent to each side of each tongue which extends in each external vertical section, said tongues being contained within the vertical walls of said members of the lower support layer and the slots of said members of the lower support layer and said members of the upper support layer being in inter-restraint. The pallet helps protect the household appliance during transport, specifically the exposed parts of the household appliance. However, the pallet does not impede, that when the household appliance is at an incline, or given the movement of the transport vehicle, the suspended parts not be moved. Thus, whereas it protects the household appliance for transport where no inclination takes place and one with constant movement, it does not protect the household appliance during transport involving inclination/tilting and with irregular movement (stops and starts).

Solutions to the problem stated above, are also found in the field. For example U.S. Pat. No. 4,019,672 make known an insert to the packaging which is formed from a preformed material of swaged sheets and is adapted to be inserted into a container with multiple sides to position a product in a predetermined relation within the inner container. The insert includes a base panel which has a periphery configuration which substantially conforms to the defined area by the side walls of the container. Connected in a bendable way to the periphery of the base panel and disposed adjacent to the predetermined corners of the same, are a plurality of support units. Each unit contains a first section of the same which has a surface of the base panel and a second section which is projected from the same. Each support unit is maintained in positioning condition by an elongated retaining member which rises from the base panel. The perform material used in this reference has the advantage of protecting the inner lower part of the household appliances. However, it does not prevent the suspended parts from moving during titling while being transported. Additionally, the amount of material used to create the base is substantial.

U.S. Pat. No. 4,240,550 makes known an agitator and a basket for a vertical axis washer which protects against damage during transport by a plurality of plastic foam rigid braces which are arranged in radial shape around the agitator. The inner extremes of the grasp are forced to become engrained in a tight way with the upper part of the machine agitator's extreme and the outer extremes of the grasps are firmly forced to become engrained to the machine's casing and the upper extremes of the machine's basket. The inner and outer extremes of the grasp are especially configured to improve the security and ease with which the grasps are adjusted to the machine. This invention allows insuring that certain moving parts, such as the agitator and the basket, are conformed to the tub. However, they do not avoid the damage during the tilting during transportation to the impulse and transmission systems.

U.S. Pat. No. 4,700,832 makes known a collapsible packaging grasp for a washer which has three or four support arms. One of the arms is formed by restraint of two of the elongated members, one of which carries a male unit portion and another which carries a female unit portion. The other support arm is a single construction and is integrated to the outer wall of the central ring. This invention ensures that certain moving parts, such as the agitator and the basket, are conformed to the tub. However, it does not avoid damage during inclination during transport to the impulse and transmission systems.

U.S. Pat. No. 5,016,853 makes known a device to support a member vertically, such as a Christmas tree, a flag pole, a sail or similar, being composed of two or more pieces of plane cardboard or any other bendable material which is bent and assembled in a support device forming a rigid symmetrical construction when folded. While this invention could support and carry an intermediate suspended structure, it is not explicitly built for the previous, and it is possible that it cannot be used for this.

Mexican patent application number PA/a/2006/014142, now Mexican patent number 267458 equivalent to U.S. Pat. No. 7,014,160 makes known a base for a household appliance for a washer type which has a washer shaft and a mechanism which extends under the washer shaft, the base comprising: a tray which has a rectangular bottom panel substantially plane to support the washing machine; and an insert placed within the tray which has an orifice centrally placed to receive and support the washer's mechanism, the insert being formed of a single cut and folded template; where the tray additionally comprises four corners and the insert also comprises four feet which extend in radial shape from the centrally placed orifice towards the four corners of the tray, each foot comprising a pair of panels angled to the bottom and connected length-wise to a first folded line which extends from the centrally placed orifice, each panel angled towards the bottom forms a downward slope from the first folded line to the union panel which is coupled face to face and is fixed to the tray's bottom panel, each panel angled towards the bottom and the corresponding union panel form an obtuse angle. One of the disadvantages of this patent is the amount of material used. Additionally, this patent does not protect the side walls of the household appliance. Due to the shape of the tray, it is possible that during transport, especially during the starts and breakings of the means of transport, the tray collapse and break, especially in light of the weight of the impulse and transmission systems.

Finally, International Publication WO number 2008/119634 makes known a means of support for washers/dryers which is placed within the body inserted through an opening such that the moving components, like the motor and the tub are prevented from knocking and impacting the body when it oscillates during transport and a lid mounted to the support means which is used when closing the opening after transport. This patent does not complement the side walls of the household appliance.

Therefore, it is an aspect of the present invention to provide a base for the transportation of vertical axis washers which shall absorb knocks, prevent oscillations of the suspended parts and protect the impulse and transmission systems during the transport of said washer.

Another aspect of the present invention is to provide a base for the transportation of household appliances which shall absorb knocks, prevent oscillations of the suspended parts and protect the motor of the household appliances, as well as the impulse system if the household appliance has one, during the transport of said household appliance.

Another aspect of the present invention is to provide a base which does not need to be completely removed once the household appliance is installed in its final position.

Another aspect of the present invention is to provide a base which can be easily mounted and un-mounted.

Yet, another aspect of the present invention is to provide protection to the whole household appliance during transport, including the side walls and the upper part of the same.

Another aspect of the present invention is to provide savings of the packaging material.

BRIEF DESCRIPTION OF THE INVENTION

The present invention relates in part to a base for the transport of household appliances. The present invention refers more specifically to the base, posts and lid to protect, absorb the shocks and prevent oscillations of the suspended parts of a household appliance. The present invention is especially crafted for a vertical axis washer; however, it can be implemented for any type of household appliance. In the vertical axis washer, the base of the present invention ensures the impulse system as well as the transmission system and any other mechanism which is found suspended to the lower part of the household appliance during transport to protect said systems from oscillating during transport, even when the household appliance is tilted.

The base, partly, is composed of two laminated elements, which are substantially perpendicular, among them forming a cross-piece. Each laminate is composed of two inclined parts substantially opposite and of a center. The center is found between each of the two inclined parts substantially opposite and near one of the two extremes of the two inclined parts substantially opposite, where the center is substantially plane and conforming to a tray. In this way, the cross-piece has a substantially pyramid shape, whose upper part is substantially flat, i.e. a truncated pyramid shape. The center of a first laminate overlaps the center of a second laminate. Each center has an opening approximately of the same dimension. The overlapped centers are capable of supporting, partially, the impulse or transmission systems. In turn, each one of the inclined parts is composed of a part substantially plane and two parts substantially perpendicular to the part substantially plane on each lateral extreme of said substantially plane part. That is, a cross section of each inclined part would show a substantially similar form to a "U". This substantially similar form to a "U" of each inclined part allows the support, partially, the impulse system or the transmission system. On the distant extreme to the center of the inclined parts, a support is found.

One support is capable of resting on and becoming coupled to each brace. Each support is capable of supporting and becoming coupled to a lower corner of the outer casing or cabinet of the household appliance. Specifically, each support and each brace have an opening which allows them to be coupled to a restraint of each one of the walls of the cabinet or outer casing of the household appliance. Each support has a section which is maintained beneath the household appliance and a section which protrudes conforming to the household appliance.

Conversely, on the base, a tray is found, with a shape substantially similar to the lower part of the household appliance. The tray has a first surface on a substantially horizontal plane, and at least partially, a second surface on a substantially vertical plane. Even when the second surface can be formed along the first surface's length, the second surface can be partial, preferably formed only closely to the tray's corners.

Each brace of the cross-piece and each support are capable of resting on each of the corners of the tray. Specifically, each of the cross-pieces braces is capable of resting on the first surface of the tray. When they are in mounted position, each support and each brace run into the second surface of the tray. In this way, each support, and at least partially, each brace of the cross-piece, is capable of cushioning the oscillations of the impulse system and the transmission system against the second surface of the tray.

A substantially parallel bar to at least one side of the tray is placed to one side substantially perpendicular to an opposite side of the tray. The tray is capable of maintaining the tray's shape, even when the tray is cushioning or not the possible oscillations of the impulse system and the transmission system of the household appliance.

Each one of the supports, specifically each section which protrudes according to the household appliance of the supports, helps maintain a post erect. The posts have a shape substantially similar to the corner of the household appliance. The posts run substantially the entire height of the household appliance along the length of each corner of the household appliance. In the opposite extreme, each post is able to support a cover or crown or support and guide a casing which covers the household appliance. Other pieces can be provided to the protection system of the household appliance, specifically for the inner parts of the household appliance.

Each one of the parts is capable of being removed when the household appliance is being installed.

BRIEF DESCRIPTION OF THE FIGURES

The particular characteristics and advantages of this invention, as well as other objectives of the invention, shall become apparent from the following description, taken in context with the accompanying figures, which:

FIG. 15 is a lower view in cross section of the example of the household appliance, of the laminate and of the supports.

FIG. 16 is a lower view of the example of the household appliance, of the laminate, of the supports and of the posts, showing the relation between these and the household appliance.

DETAILED DESCRIPTION OF THE INVENTION

While the present invention can be intended for any type of household appliance, with any base shape type, as an example, a preferred base with a square or rectangular shape shall be presented and the concept of packaging of the present invention shall be presented with a vertical axis washer as an example. The system works in a similar way for other household appliances, however, the dimensions and proportions are some of the elements that shape the base and other packaging elements are different and depend on the type of household appliance and/or system being used. The materials which make up the packaging can vary, however, strong materials are preferred, which do not bend easily but which possess certain flexibility. Examples of such are, polystyrenes, PVC, high density polyethylene, polypropylenes, PET, etc., wood, metals which tend to have certain flexibility, laminated paper, cardboard, corrugated cardboard, etc. Certain components, such as the support, are preferred to be made of materials capable of absorbing impact. A preferred material is polystyrene, specifically expanded polystyrene (EPS).

Figure 1:
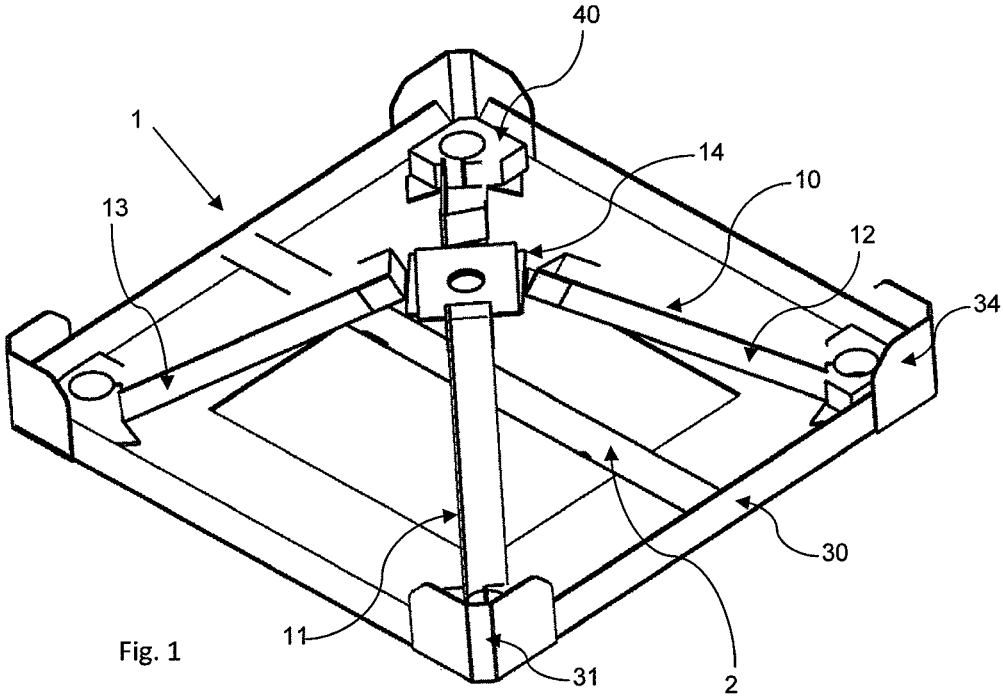
FIG. 1 is a view in conventional perspective of the base of the present invention.
Figure 2:
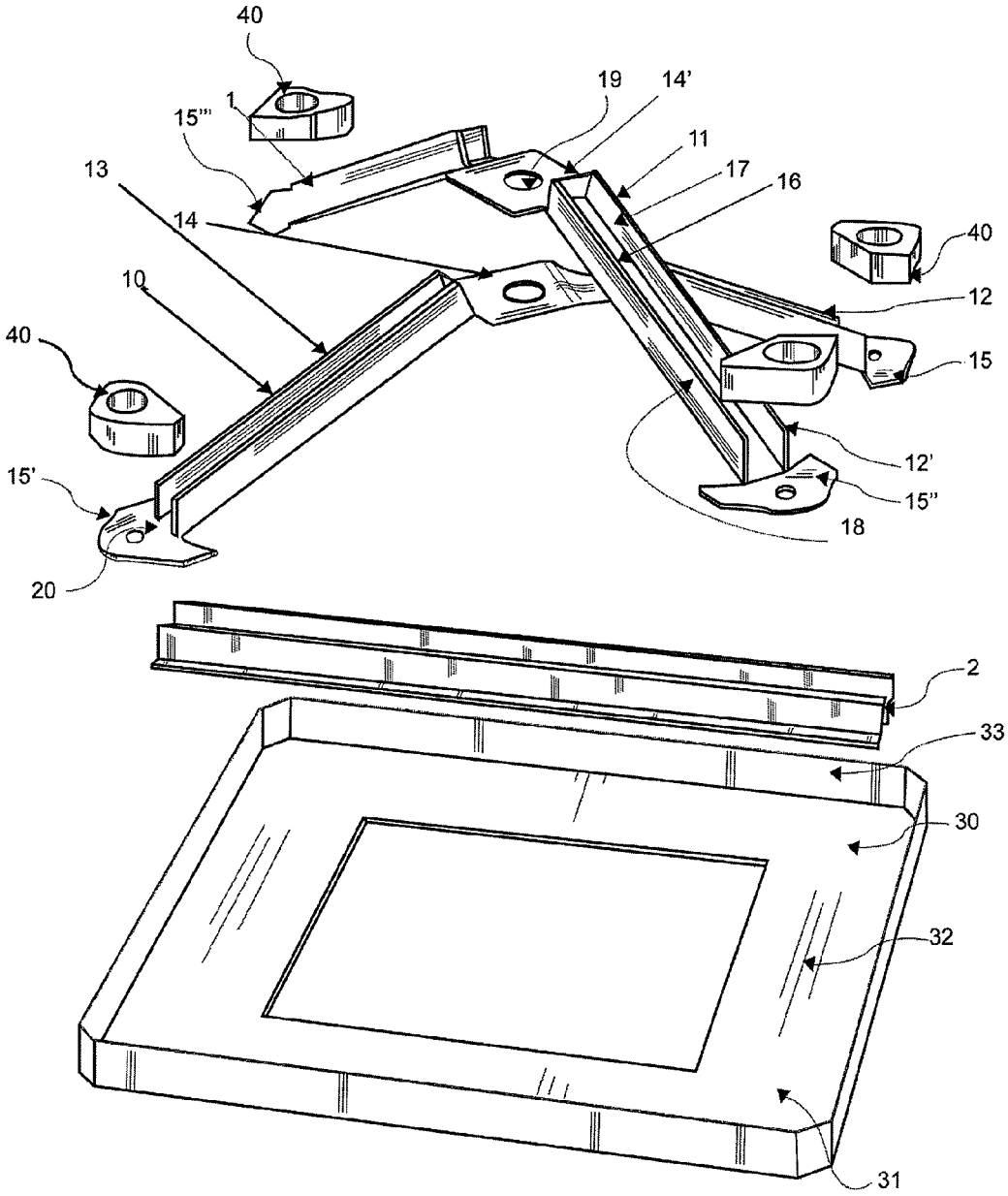
FIG. 2 is an exploded view of the base.
Figure 3:
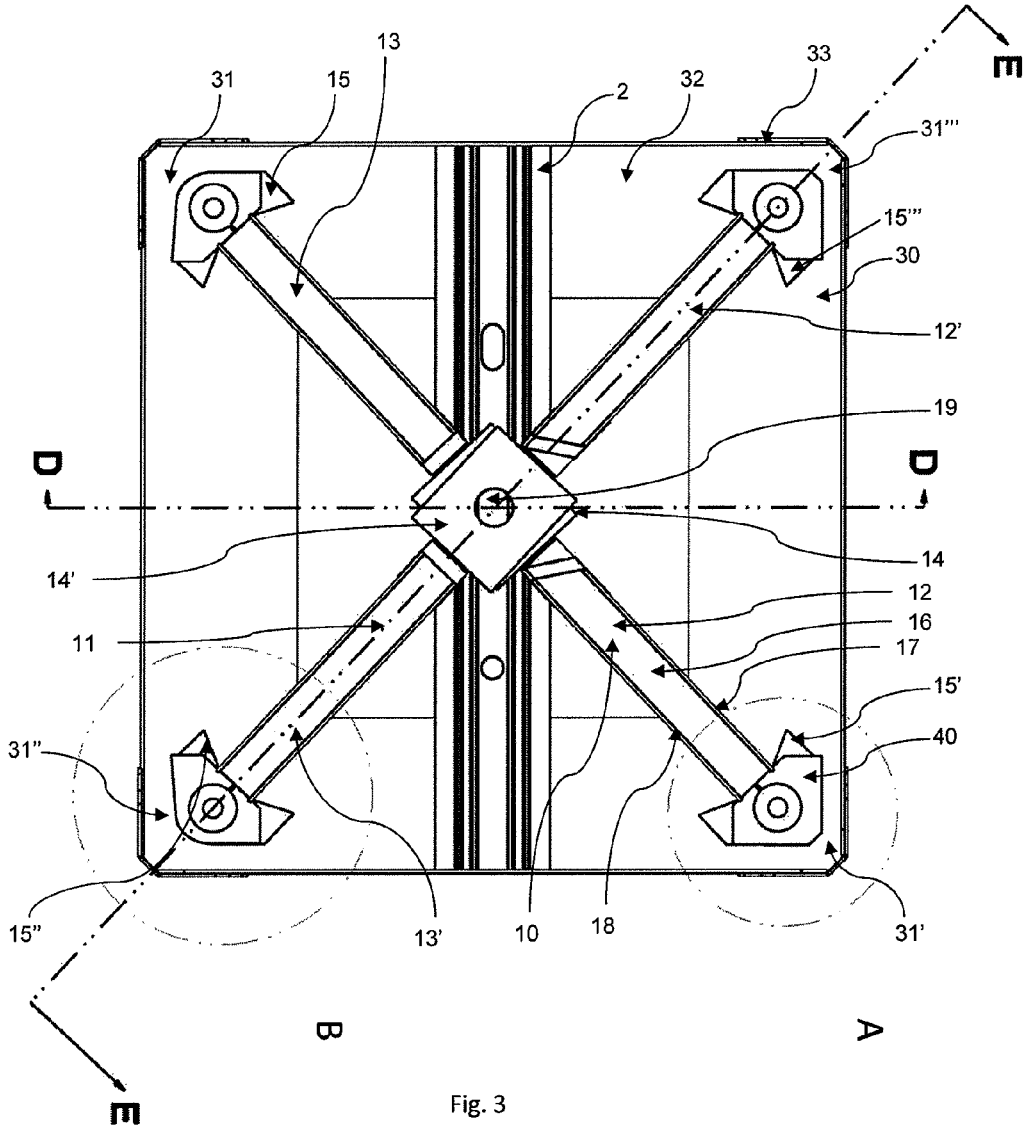
FIG. 3 is an upper view of the base.
Figure 4:
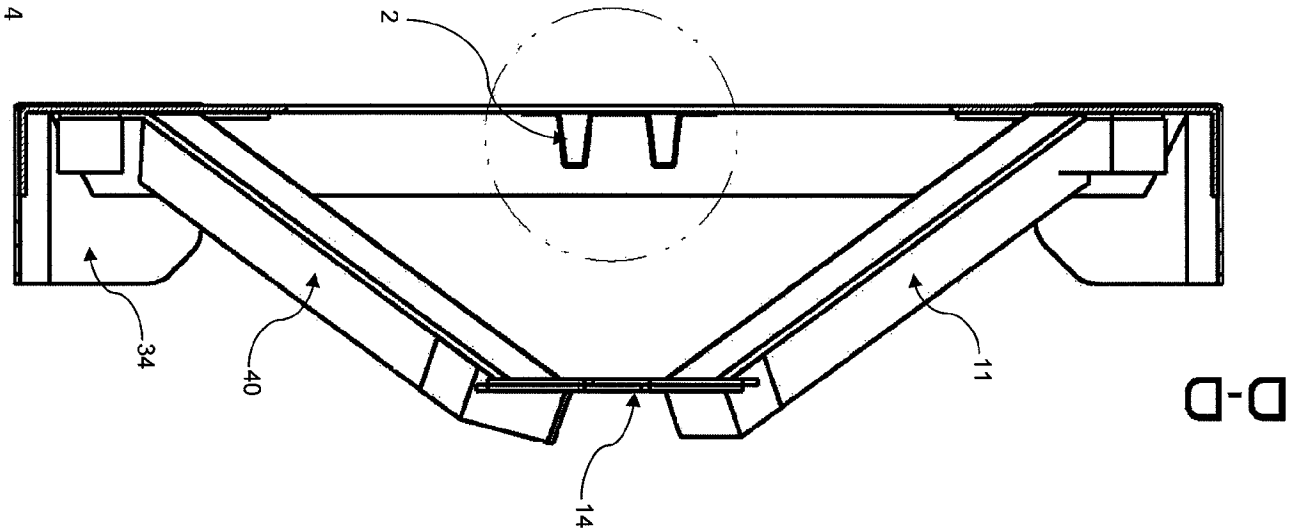
FIG. 4 is a cross section along the length of lines D-D of FIG. 3.
Figure 5:
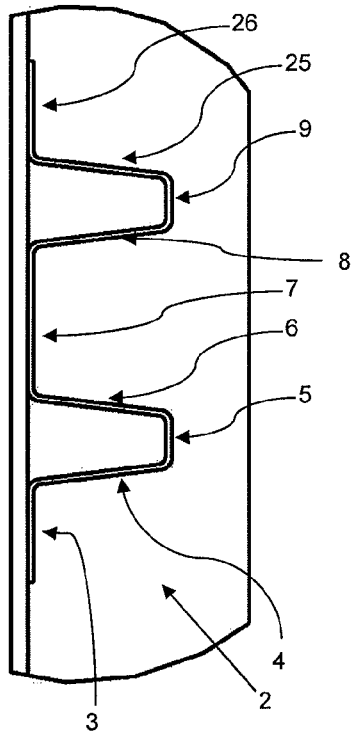
FIG. 5 is a view in detail of FIG. 4.
Figure 6:
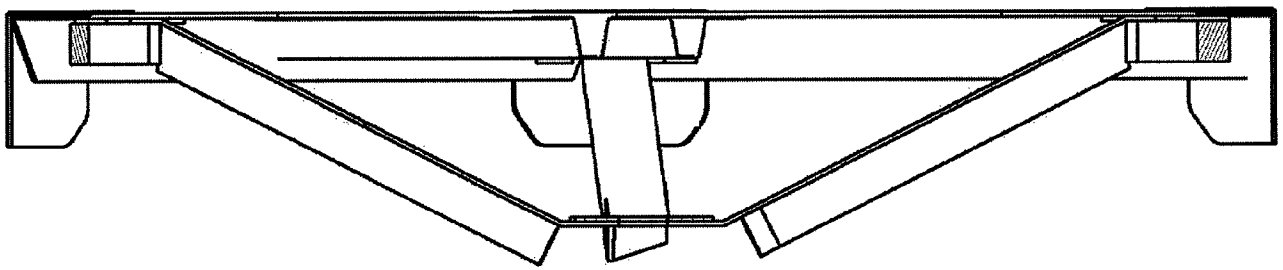
FIG. 6 is a cross section along the length of lines E-E of FIG. 3.

In a general way and in relation to FIGS. 1 through 3, a view in conventional perspective is presented, a view in explosion and an upper view of the packaging base 1, respectively. The base 1 is made up of distinct main parts, such as are the at least two laminates 10, 11, a tray 30, a support 40 per each corner of the tray 30, and a bar 2.

The tray 30 is provided with a shape substantially similar to the shape of the lower part of the household appliance. The tray 30 is generally composed of a first surface 32 in a substantially horizontal plane and a second surface 33 in a substantially vertical plane. Both surfaces 32, 33 are substantially perpendicular between them. It is preferred that surface 32 be on the outer part, while surface 33 be placed on the inner part. Even when surface 33 can be formed along the length of the surface 32, surface 33 can be partial, being formed only near the corners 31 of the tray. The corners 31 are formed from the union of each of the tray's 30 sides.

A first laminate 10 is composed of two parts 12, 13 substantially opposite, which have a set determined inclination. Each of the two parts 12, 13 have two extremes. The first laminate 10 has a center 14 which unites both parts 12, 13 by means of one of the two extremes of both parts 12, 13. The center 14 is found substantially centric in relation to the length of the two parts 12, 13. The center 14 is substantially plane regarding the tray 30. In a substantially centric part of the center 14, an aperture 19 is found. On the opposite extreme of the extreme joined to the center of the two parts 12, 13, a brace 15 is found. A brace 15 rests on each one of the corresponding corners 31 of the tray 30. Just as was previously mentioned, the first laminate 10 is composed of two parts 12, 13 which are inclined in relation to the center 14. This inclination is determined by the height at which the center 14 is found. That is, the braces 15 rest at the tray's 30 height. Both parts 12, 13 rise according to the position of the brace 15 until they are joined in their extreme to the center 14. The degree of elevation depends on the length of the parts 12, 13 and further depends on the height of the suspended parts or the parts to be protected of the household appliance. Each one of the two parts 12, 13 is itself composed of one substantially plane inclined 16 part and of two substantially perpendicular parts 17, 18 to said substantially plane part 16. Thus, a cross section of each one of the two parts 12, 13, would show that both parts 12, 13 have a substantially similar shape to a "U". However the first 12 and the second 13 part of the laminates 10, 11 are substantially shaped like a "C", "L", "T", "O", "Δ", "Π", "⌂", "□", or whose inertia moment is similar or superior to any of the previous. A second laminate 11 is substantially composed in the same way as the first laminate 10. That is, the second laminate is also composed of a first inclined part 12' and a second inclined part 13' opposite to the first part 12'. In between both parts 12', 13' and joined to an extreme of each one of the two parts 12', 13', is a center 14', substantially plane in relation to the tray 30, center 14', which has an aperture 19'. In the opposite extreme of each one of the two parts 12', 13', a brace 15' is found, which rests on a second corresponding corner 31 of the tray 30. Both parts 12', 13', are composed of a substantially plane part 16', as well as a first and second part 17', 18', perpendicular to the substantially plane part 16', in such a way, that it substantially forms a "U" when looking at both parts 12', 13' in a cross section. The centers 14, 14' of the two laminates 10, 11 overlap when the base 1 is in mounted position, in such a way, that when they are in a mounted position, both laminates 10, 11 have a truncated pyramid shape, that is to say, with the upper part substantially flat. In this way, the first laminate 10 crosses the base 1 diagonally, while the second laminate 11 crosses the base diagonally in the opposite direction of the first laminate 10, in such a way, that when seen from above, the laminates 10, 11 substantially form an "X". Each one of the two braces 15, 15' of the first laminate 10 rests on the opposing corners 31, 31' of the tray 30. Each one of the two braces 15", 15'" of the second laminate 11 rests on the opposing corners 31", 31'" of the tray. The extreme of each brace 15 which is opposite to the extreme which is in contact with the first 12, 12' and second 13, 13' part of the laminates 10, 11 has a shape such that it is coupled to the corners 31 of the tray 30. When it is in a mounted position, the centers 14, 14' of the base 1 and/or at least part of the laminates 10, 11, maintain the impulse system and/or the transmission system in place: when the systems are tethered to the centers 14, 14' of the base 1 and with at least part of the laminates 10, 11, the systems create a push force, specifically transferring gravity force from the suspended systems against the centers 14, 14', so that this force is transferred to the laminates 10, 11 and they in turn cause the braces 15 to slip towards the borders of the corners 31, until said braces 15 push up against the surface 32 of the borders 31 of the tray 30. Thus, the shape of the brace 15 is able to mold itself to the border 31. It is preferred that the braces 15 be substantially plane. The braces 15 have, in a substantially centric part, an aperture 20.

A support 40 is coupled with and rests over each brace 15 of the laminates 10, 11.

In the following section, FIGS. 1 through 5 will be referred to in a general way. While the laminates 10, 11 are crossed in a diagonal manner regarding the tray 30, a bar 2 is found which crosses from one side of the tray 30 to the opposite side of the tray 30 at a substantially centric point in parallel form to one of the trays 30 sides, and especially in collinear manner in at least one point of the bar 2, with the centers 14, 14' of the laminates 10, 11. Such as is shown in the cross section in FIG. 4, on the cut lines D-D of FIG. 3, and more specifically in the detailed view shown in FIG. 5, the bar 2 is formed of a first surface 3 which is found substantially on the same plane as the surface 32 of the tray 30. Partially, this first surface 3 rests on said surface 32 of the tray 30. Having finished the first surface 3, a first elevation 4 is found, which has on its end a first crest 5 and a first slope 6. At the end of the first slope 6, a second surface 7 is found at a height substantially similar to that of the first surface 3. This second surface 7 has a width of $A_1$ such that it is substantially similar to the diameter or the length of the aperture 19 of the centers 14, 14' of the two laminates 10, 11. Having finished the second surface 7, a second elevation 8 is found on whose end there is a second crest 9 and a second slope 25. The width of the second surface 7 is delineated by the first slope 6 and the second elevation 8. At the end of the second slope 25 is found a third surface 26 at a height level substantially similar to the first 3 and second 7 surfaces. In part, the second surface 7 and the third surface 26 are also being supported on said surface 32 of the tray 30. This shape attained by the pair of elevations 4, 8 as well as the different surfaces 3, 7, 26 of the bar 2, is maintained along the length of the bar 2. However, this shape is not limited to the previous and different type of extrusions can be found, such as shapes which substantially can be formed like a "C", "L", "T", "O", "Δ", "Π", "⌂", "□" or whose inertia moment be similar or higher than any of the above.

The aforementioned that is, the centers 14, 14' specifically the apertures 19 of the centers and the second surface 7, specifically the collinear sections of the second surface 7 with the apertures 19 of the centers 14, 14' maintains, with certain rigidity the transmission system of a vertical axis washer. That is, the transmission system of a vertical axis washer, usually comprises, among other pieces, a clutch 50 such as is shown in FIGS. 15 and 16. The clutch 50 comprises two parts, an upper part and a lower part, the lower part or the upper part being capable of sliding upwards or downwards to be clutched or un-clutched between them, and in this way, solely rotate an agitator, propeller or similar as well as the basket. It is common that the lower piece be a pulley or sprocket and on whose lower face a plurality of striates are joined to a center. The shape of the lower face's center of the lower piece will determine substantially the form of the apertures 19, 19' of the centers 14, 14' of the laminates 10, 11.

The bar 2 has the function of lending support to the lower face for the lifter which the bag applies and protection for the fastener.

Figure 7:
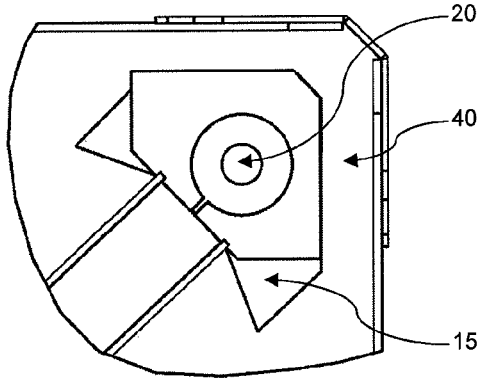
FIG. 7 is a detailed view of A in FIG. 3.
Figure 8:
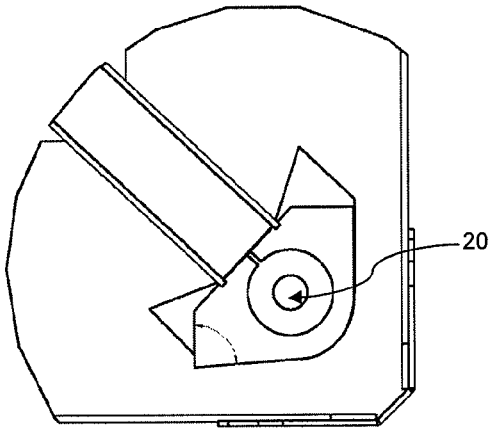
FIG. 8 is a detailed view of B in FIG. 3.

Regarding FIGS. 6 through 10 and especially as it relates to the support 40, the relationship between the support 40 with the rest of the base 1 shall be described. The support, such as is shown in FIGS. 7 and 8, and also in 9 and 10, can be shaped in differing configuration forms. The only requirement is that the support 40 can be coupled with and rest on the brace 15 on each one of the laminates 10, 11 extremes, as well as be able to maintain the posts 60 in an erect position. The support has a substantially centric part of the same, an aperture 41. When the support 40 rests on the brace 15, it is necessary that the aperture 41 of the support be substantially collinear with the aperture 20 of the brace, in such a way, that when they are crossed, the laminates 10, 11 be securely fastened with the supports 40 to the household appliance cabinet's 51 extremes, providing certain rigidity to these components, so that the transmission system and/or the impulse system not oscillate during transport of the household appliance. The way in which to cross and fasten the laminates 10, 11, specifically the extremes of the parts 12, 13 and more specifically, by means of the apertures 20 in the braces 15, to the supports 40, specifically the aperture 41 of the supports, to the extremes of the cabinet 51, specifically by means of the cabinet's 51 corners, is by a means of fastening 52, such as for example can be a screwed means. The support 40, in light if its impact absorbing quality, is capable of supporting and lodging a lower corner of the outer casing or cabinet 51. When the household appliance is mounted on the support 41, a section of the support 40 remains under the household appliance, while another section of the support 40 remains on the outside the household appliance.

Figure 9:
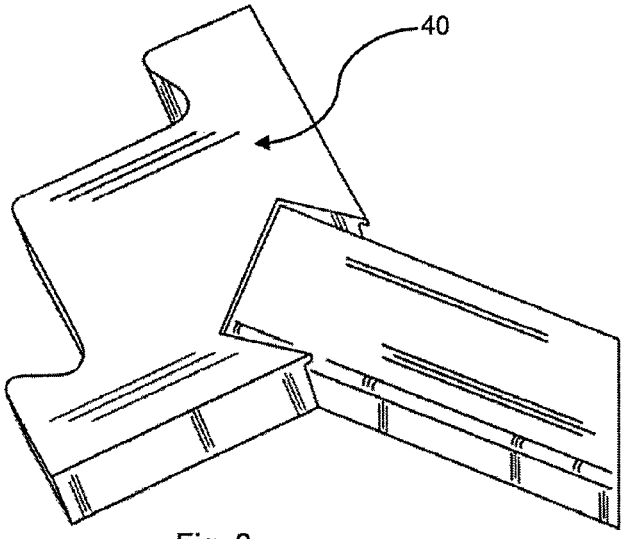
FIG. 9 is a lower view of an extreme of the laminate and the support.
Figure 10:
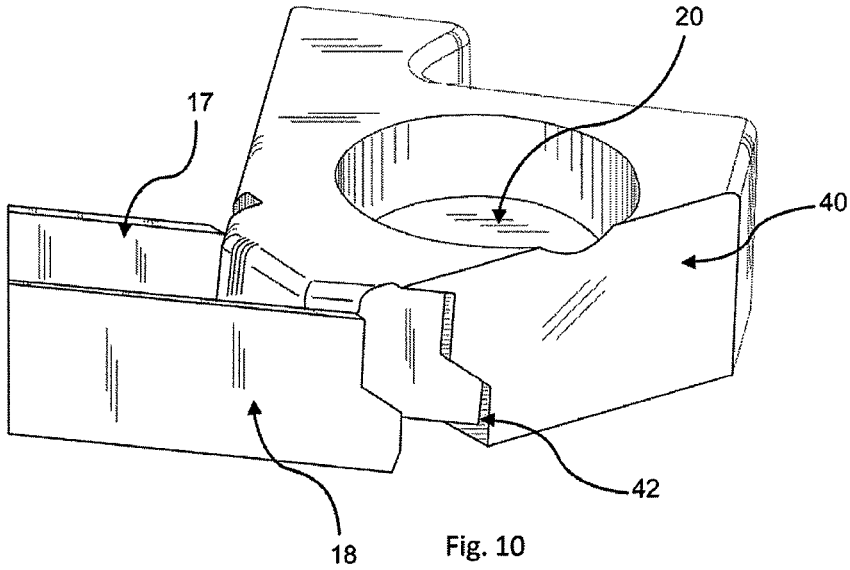
FIG. 10 is a view in perspective of one extreme of the laminate and of the support, as well as a cut of the support.

Specifically referencing FIGS. 9 and 10, the support 40 is capable of being coupled with the laminates 10, 11 independently of the fastening means. On a lower part of the support 40, there is a groove 42, which can have any shape, however, a particular form is preferred to ensure better coupling between the laminates 10, 11 and the support 40. Specifically, the extreme closest to the support 40 of the first 17 and second 18 perpendicular part, have the same shape than that of the groove 42 of the support. In this way, when the support 40 is coupled with the laminates 10, 11, the extremes of the first 17 and second 18 perpendicular parts are pushed up to the groove 42 of the support. Even further, it is possible that one extreme of the support 40 can be lodged between the first 17 and the second 18 perpendicular parts and on the plane part 16. In this way, it is ensured that partial coupling between the supports 40 and the laminates 10,11 occurs; the total coupling between these parts is ensured by the fastening means 52 which crosses the apertures 20, 41.

Figure 11:
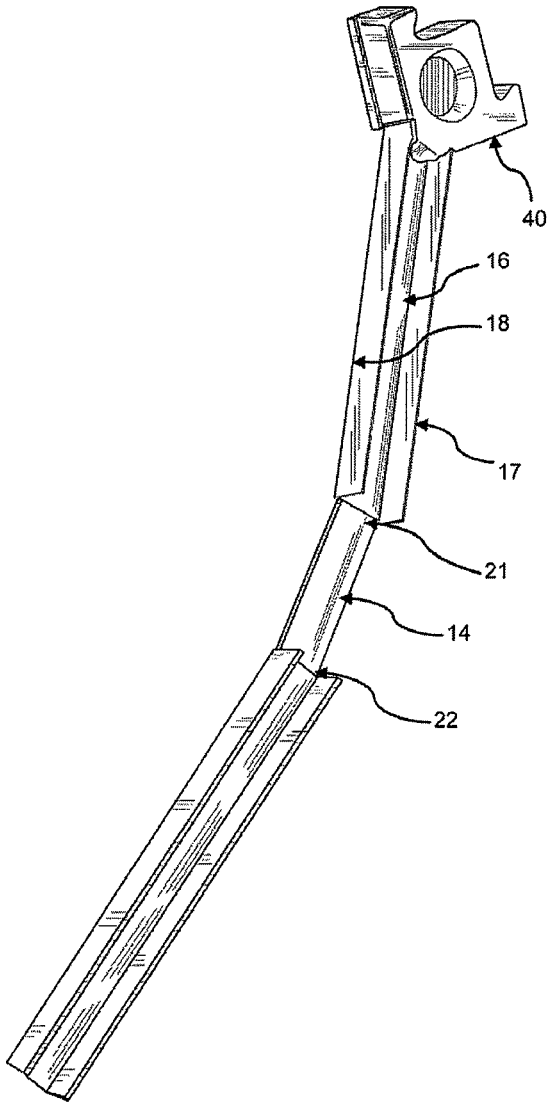
FIG. 11 is a view in perspective of the laminate joined on one extreme to one support.
Figure 12:
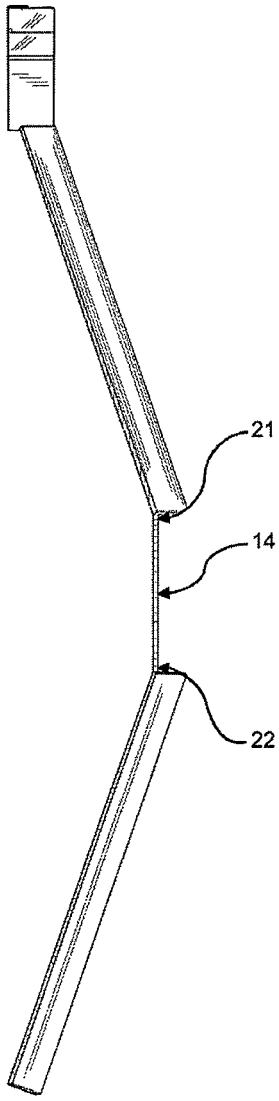
FIG. 12 is a lateral view of the laminate joined on one extreme to one support.

As was previously mentioned, the first laminate 10 crosses the base 1 diagonally, while the second laminate 11 crosses diagonally to the base, in opposite direction to the first laminate 10, in such a way that when seen from above, the laminates 10, 11, substantially form an "X". In similar fashion, as was previously mentioned the centers 14, 14' of the laminates 10, 11 are overlapped between them. To overlap, it is necessary to remove along the length of the center 14, 14' both perpendicular parts 17, 18 of the laminates 10, 11. Thus, the substantially plane surface of the centers 14, 14' does not have sides. This can be more easily visualized from FIGS. 11 and 12. Additionally, upon not having the two perpendicular parts 17, 18 of the laminates 10, 11 in the centers 14, 14', allows that between the borders 21, 22 both perpendicular parts 17, 18 closest to the centers 14, 14', the transmission system and/or impulse system be partially housed and in this way, further avoid oscillation of said impulse and/or transmission system, such as can be seen in FIGS. 15 and 16.

Figure 13:
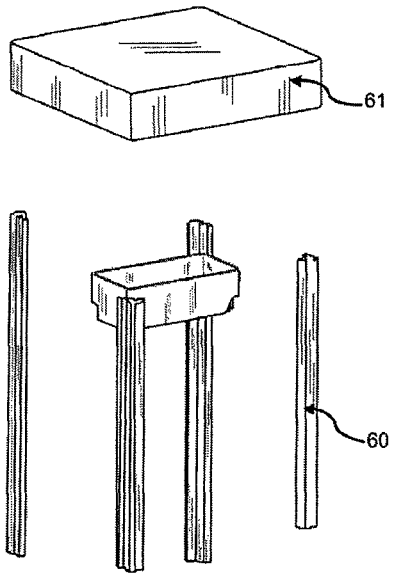
FIG. 13 is an exploded view of each one of the parts of the collapsible packaging.
Figure 13:
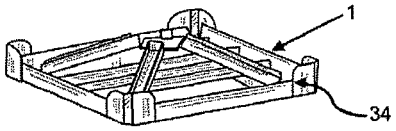
Figure 14:
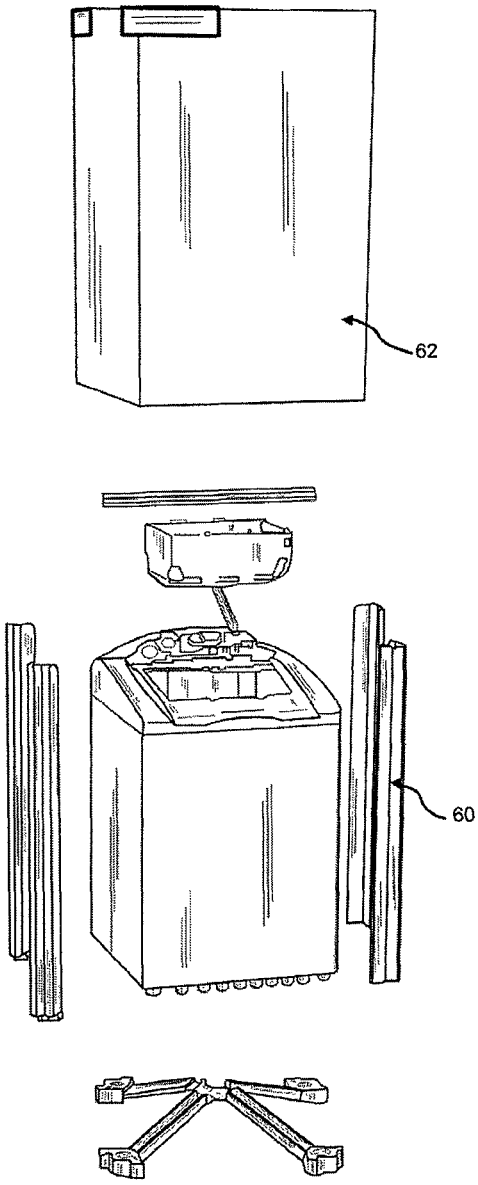
FIG. 14 is an exploded view of each one of the parts of the collapsible packaging, relating each part to a household appliance example.

Such as can be seen in FIG. 13, when the base 1 is mounted, it is ready to receive the lower part of the household appliance. It is preferred that the corners 31 of the tray 30 have reinforcements 34. These reinforcements 34 aid in maintaining, partially, the posts 60 in an erect position. One post 60 per corner 31 of the tray is provided. The posts 60 have two substantially angular walls. That is, the posts are conformed by two faces on a plane Z and W, taking into account that the surfaces 32, 33 of the tray 30 are on an X and Y planes, where a first face of the post is substantially perpendicular to a second face of the post. In this way, the posts 60 are coupled to both the tray's corner 31 as well as the extremes of the support 40, so that when the base 1 is in position, said supports 40 shall be pushing the lower extremes of the posts 60, maintaining, in part, the posts 60 erect. The posts 60 are designed to run the entire length of the household appliance, such as can be seen in FIG. 14. On the upper part of the posts, a lid 61 or crown can be fastened on. Optionally, it can be fastened by means of a casing 62 which covers the household appliance as such. Alternatively, the household appliance can be wrapped by a plastic.

Alterations to the structure described in the present can be foreseen by experts in the field. However, it should be understood that the present description is related with the preferred embodiments of the invention, which is merely for illustrative purposes and should not be construed as a limitation of the invention. All modifications which do not depart from the spirit of the invention are included within the body of the attached claims.

The invention claimed is:

1. A packaging base for an appliance packaging system, the packaging base comprising:

a) a tray with a first surface, a second surface and four corners, wherein the second surface is substantially perpendicular to the first surface;

b) a first single-piece element and a second single-piece element, each single-piece element comprising:

i) a first part with a first inclination, wherein said first part comprises a substantially plane part and longitudinal parts formed at the longitudinal edges of the substantially plane part, wherein the longitudinal parts extend substantially perpendicular relative to the substantially plane part of the first part;

ii) a second part with a second inclination which is inverse relative to the first inclination of the first part, wherein said second part comprises a substantially plane part and longitudinal parts formed at the longitudinal edges of the substantially plane part of the second part, wherein the longitudinal parts of the second part extend substantially perpendicular relative to the substantially plane part of the second part;

iii) a substantially plane center not having sides and located between the first part with the first inclination and the second part with the second inclination;

iv) a substantially plane brace at each distal end of said first and second parts of said first single-piece element and said second single-piece element;

c) wherein said first single-piece element and said second single-piece element are placed on the tray transversal to each other, wherein the center of said first single-piece element is positioned to overlap with the center of said second single-piece element, wherein the first brace of the first single-piece element is arranged to affixably rest on a first corner of the tray and the second brace of the first single-piece element is arranged to affixably rest on a second corner of the tray, which is diagonal relative to the first corner of the tray, wherein the first brace of the second single-piece element is arranged to affixably rest on a third corner of the tray and the second brace of the second single-piece element is arranged to affixably rest on a fourth corner of the tray, which is diagonal relative to the third corner;

d) a support on each brace of said first single-piece element and said second single-piece elements.

2. The base according to claim 1, further comprising a bar arranged to abut the second surface of a first side of the tray and further arranged to abut the second surface of a side of the tray which is opposite said first side of the tray, and wherein the ends of the bar rest on the first surface of the first side of the tray and the first surface of the second side of the tray.

3. The base according to claim 2, wherein the bar has at least two longitudinal crests and a longitudinal valley, wherein said longitudinal valley is interposed between said two longitudinal crests.

4. The base according to claim 1, where the first and second parts of the first single-piece element and the second single-piece element have two sides substantially parallel and on plane part substantially perpendicular to the two sides.

5. The base according to claim 1, wherein the respective centers in each of the first single-piece element and the second single-piece element contains an aperture, where said apertures are collinear.

6. The base according to claim 1, wherein the support has an aperture and the corresponding brace has an aperture, and wherein said apertures are collinear.

7. The base according to claim 1, wherein the support is coupled to the brace by way of a groove in the support.

8. A base according to claim 1, wherein the braces comprise an expanded polystyrene material and wherein the remaining parts of the base are made from any of the following materials: plastic, PVC, high density polyethylene, polypropylene, PET, wood, a metal having a predefined flexibility, laminated paper, cardboard, or corrugated cardboard.

9. A packaging system for than appliance which comprises:

a post for each corner of the appliance, a lid, and the packaging base of claim 1.

10. The packaging system of claim 9, further comprising a casing.

11. The packaging system of claim 9, wherein said packaging system is wrapped in a plastic.

* * * * *